United States Patent [19]

Carberry

[11] Patent Number: 4,465,026

[45] Date of Patent: Aug. 14, 1984

[54] AUTOMATIC BOILER BLOWDOWN SYSTEM INCLUDING BLOWDOWN SEQUENCE CONTROL

[76] Inventor: Victor V. Carberry, N55 W21404 Logan Dr., Menomonee Falls, Wis. 53051

[21] Appl. No.: 472,581

[22] Filed: Mar. 7, 1983

[51] Int. Cl.[3] ..... F22B 37/54

[52] U.S. Cl. ..... 122/382; 122/396; 122/451 R

[58] Field of Search ..... 122/379, 381–389, 122/396, 415, 448 R, 449; 137/392

[56] References Cited

U.S. PATENT DOCUMENTS

| | | | |
|---|---|---|---|
| 2,385,161 | 9/1945 | Pinkerton | 122/451 R |
| 2,733,693 | 2/1956 | Johnsson | 122/382 X |
| 3,377,994 | 4/1968 | Horne | 122/382 |
| 3,680,581 | 8/1972 | Holdt | 122/382 X |
| 4,285,302 | 8/1981 | Kelly | 122/396 X |

FOREIGN PATENT DOCUMENTS 2033000 1/1972 Fed. Rep. of Germany ... 122/451 R

*Primary Examiner*—Henry C. Yuen

[57] ABSTRACT

A blowdown system for controlling blowdown of a boiler such that the level of dissolved solids in the boiler is carefully controlled. The system includes a blowdown tank connected to the bottom of a boiler. Controls are provided for causing blowdown when the content of dissolved solids in the boiler water reaches a first level. Surface blowdown is caused when the dissolved solids reach a second level and a controlled or modulated increase in surface blowdown can then be provided so as to cause surface blowdown proportional to the level of dissolved solids in the boiler water. Blowdown can also be provided through alternate water columns.

17 Claims, 2 Drawing Figures

AUTOMATIC BOILER BLOWDOWN SYSTEM INCLUDING BLOWDOWN SEQUENCE CONTROL

FIELD OF THE INVENTION

The present invention relates to apparatus for automatically discharging sediment from boilers and more particularly to automated and controlled apparatus for discharging sediment from boilers in response to sensed conditions of the water in the boiler.

BACKGROUND PRIOR ART

In the past it has been necessary for boiler operators to periodically discharge water from the boiler in order to flush the boiler of built up mineral deposits and impurities. Prolonged operation of a boiler without such blowdown of the boiler can result in mineral buildup in the boiler and in the related pipes, thereby substantially reducing the efficiency of operation of the boiler and eventually causing the pipes to be substantially restricted.

More recently, apparatus has been developed to provide for automated blowdown of boilers at selected intervals. An example of such apparatus is illustrated in the Anderson U.S. Pat. No. 3,908,605, issued Sept. 30, 1975.

Attention is also directed to the Cancilla et al. U.S. Pat. No. 3,802,398, issued Apr. 9, 1974; the McNeil et al. U.S. Pat. No. 3,668,838, issued Jun. 13, 1972; the Kensig U.S. Pat. No. 1,812,050, issued Jun. 30, 1931. Attention is also directed to the Madden U.S. Pat. No. 2,270,067, issued Jan. 13, 1942; the Holdt U.S. Pat. No. 4,070,992, issued Jan. 31, 1978; the Kelly U.S. Pat. No. 4,285,302, issued Aug. 25, 1981, and the Rice U.S. Pat. No. 2,597,597, issued May 20, 1952.

In an effort to control mineral buildup in boilers, it is common practice to add chemicals to the water going into the boiler in order to increase the tendency of the minerals to remain in a dissolved state and to thereby prevent collection of solids in the boiler or in the pipes of the heating system. These chemicals are added in amounts depending on the maximum level of dissolved solids existing in the water in the boiler.

In the prior art apparatus, it is common that the boiler will be subjected to blowdown on a timed sequence. During the period of time between blowdown operations, i.e., discharge of sediment from the boiler, the amount of dissolved solids in the water will increase from a relatively low value immediately following the blowdown step to a substantially higher value just prior to the next blowdown. During this time period between blowdowns, make-up water is added to the boiler, and the amount of minerals in the system is increased each time water is added. The amount of chemicals added to the make-up water is dependent on the maximum value of total dissolved solids in the water prior to blowdown. With the prior art apparatus, there is normally a substantial fluctuation in the amount of dissolved solids in the boiler water during each full blowdown cycle. To prevent accumulation of deposits in the boiler and the related conduits of the heating system, chemicals must be added in amounts sufficient to handle the content of the water in the boiler just prior to blowdown. If the fluctuations of the level of dissolved solids in the water go through a wide range, substantially more chemicals must be added to the water than are necessary if the range of the level of impurities is held within a narrowly controlled set of parameters.

Another feature of the prior art apparatus is that sediment commonly collects in the low water cut-off mechanism float chambers or water columns. If this sediment collection is sufficient to restrict the operation of the water columns or of the low water cut-off devices, it is possible that the water level in the boiler may reach an undesirably low level and cause damage to the boiler or even catastrophic failure.

SUMMARY OF THE INVENTION

The present invention provides an improved blowdown sytem and improved means for controlling blowdown of the boiler such that the level of dissolved solids in the boiler is carefully controlled and held within narrow limits. This has the effect of minimizing the possibility of mineral buildup in the boiler and in the steam pipes and also has the effect of substantially reducing the quantity of chemicals required to treat the make-up water added to the boiler. Improved control of the blowdown also provides improved efficiency in the energy required and reduces the usage of water.

More specifically, the apparatus embodying the invention includes a blowdown tank and means for connecting the bottom of the boiler to the blowdown tank. Means are provided for causing periodic discharge of water into the blowdown tank, i.e. blowdown. In a preferred embodiment of the invention, this means for causing periodic blowdown includes means for causing blowdown when the content of dissolved solids in the water in the boiler reaches a first level. Means are also provided for discharging surface water from the boiler when the level of dissolved solids reaches a second level, and this means can also cause a controlled or modulated increase in the amount of surface blowdown if the level of dissolved solids in the water rises above the second level and in proportion to rise of the level of dissolved solids above the second level.

The present invention also provides an improved blowdown system which permits blowdown through the water columns of the boiler and thereby effecting discharge of water through the water columns and float chambers to flush sediment from the float chambers. This system also includes means for discharging water from a selected water column and then from the other water column.

The present invention also includes a boiler blowdown system embodying a means for controlling blowdown from the boiler which permits selection of the sequence of blowdown from the bottom of the boiler as well as from the boiler water columns and means for permitting selected control of various operating elements of the automatic blowdown system as selected by the operator and in a programmed sequence as selected by the operator. This controlling means also includes means for controlling discharge of water from both the bottom of a boiler and discharge of surface water from the boiler.

Various other features and advantages of the invention will be apparent by reference to the following description of a preferred embodiment, from the claims, and from the drawings.

Figure 1:
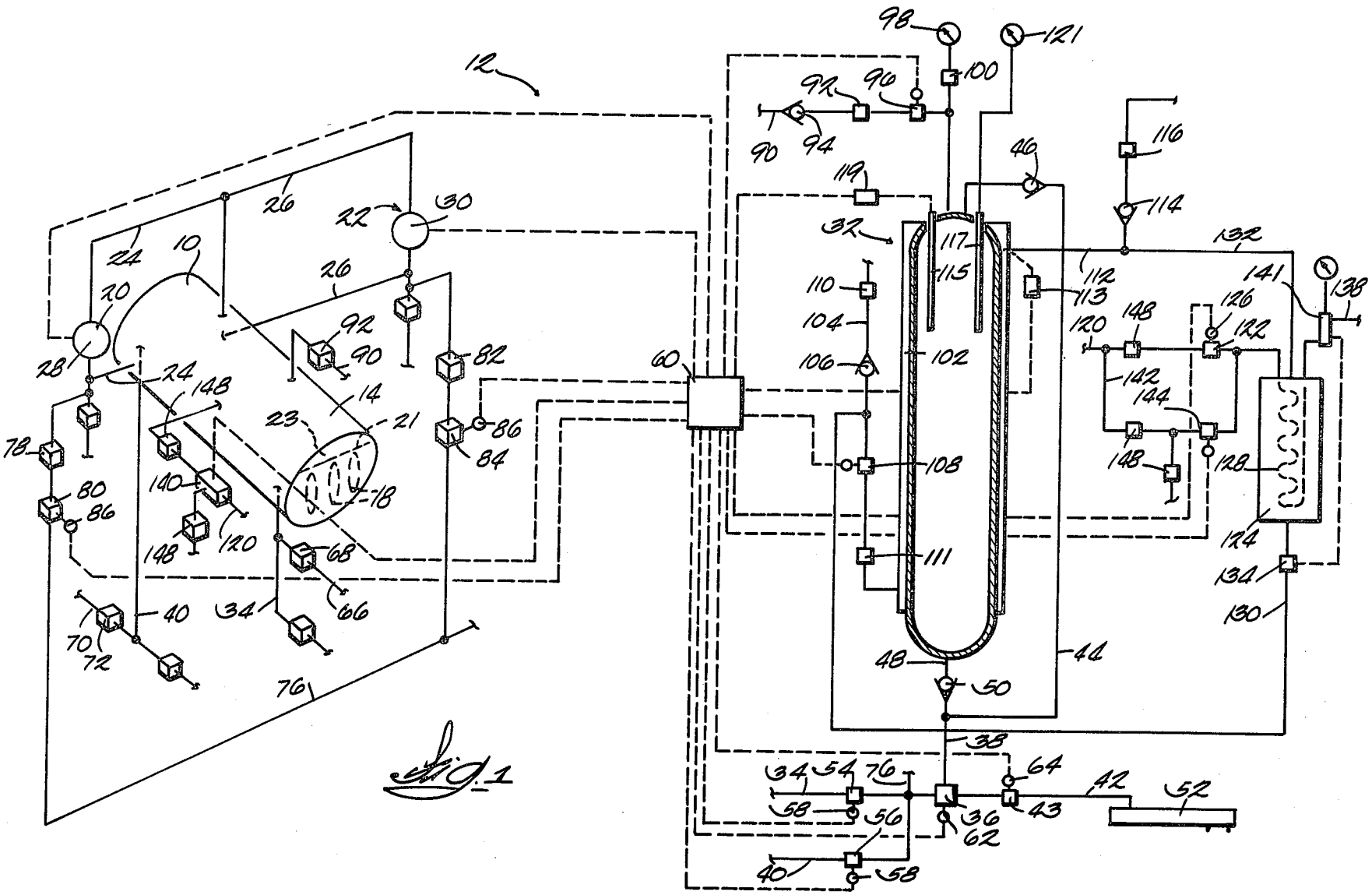
FIG. 1 is a schematic view of apparatus embodying the present invention.

Before describing a preferred embodiment of the invention in detail, it is to be understood that the invention is not limited in its application to the details of construction nor to the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF A PREFERRED EMBODIMENT

Illustrated in FIG. 1 is a boiler generally designated 10 and an automatic boiler blowdown apparatus generally designated 12 and connected to the boiler 10. In the illustrated arrangement, the boiler 10 includes an exterior generally cylindrical sidewall portion 14 adapted to receive water in the interior thereof. The boiler 10 includes a plurality of flues 18 extending longitudinally through the interior of the boiler 10 in a customary manner. The water in the boiler 10 is maintained at a level 21 wherein the flues 18 are covered by water and so that a head space 23 is maintained above the water level. For this purpose, water is supplied to the boiler 10 from a make-up tank (not shown).

Means are also provided for causing water to be supplied to the boiler 10 from the make-up tank when the water level in the boiler 10 drops below a predetermined level. In the illustrated construction, this means is shown schematically as including a pair of low water cut-off devices 20 and 22, one of the low water cut-off devices 20 functioning as a master and the other low water cut-off device 22 functioning as an auxiliary or back-up device. The low water cut-off devices are conventional and will not be described in detail. The low water cut-off devices include water columns shown schematically as elements 24 and 26 and also include float chambers 28 and 30, respectively. The float chambers 28 and 30 are located at approximately the same vertical position as the desired level 21 of the water in the boiler 10. A lower portion of each of the float chambers 28 and 30 is connected by the associated water column 24 or 26 to the boiler 10 and an upper portion of each float chamber is connected to the boiler head space 23, so that the level of water in the float chamber will be the same as that in the boiler. A float (not shown) is housed in each float chamber 28 and 30, and the position of the float in float chamber 28 functions as a means for regulating water flow into the boiler 10.

The apparatus of the invention also includes a blowdown tank or holding tank 32 operably connected to the boiler 10 to receive a charge of water from the boiler 10. Stated alternatively, means are also provided for receiving a charge of water from the boiler and for holding that charge and for then discharging that water into a drain. The blowdown tank is provided in order to permit a limited and predetermined quantity of water in the boiler 10 to be discharged while providing positive means for preventing discharge of the remaining water from the boiler. The boiler blowdown tank 32 can also function to hold a quantity of water for cooling that water prior to discharge of the water into a drain system.

Referring more particularly to the apparatus illustrated in FIG. 1, the blowdown tank 32 comprises a closed vessel or tank having a volume substantially less than the volume of the boiler, but large enough to receive a suitable quantity of water from the boiler to provide for effective blowdown of the boiler. While the boiler 10 is shown in FIG. 1 in reduced scale, it will be understood by those skilled in the art that the boiler 10 is much larger than the blowdown tank 32.

Means are also provided for connecting the bottom of the boiler 10 to the blowdown tank 32. In the illustrated arrangement this means includes a front bottom blowdown line 34 connected by means of a three-way, two port valve 36 to a pipe 38 connected to the blowdown tank 32. The means for connecting the bottom of the boiler to the blowdown tank 32 also includes a rear bottom blowdown line 40 also connected to the three-way, two port valve 36.

The three-way, two port valve 36 is particularly constructed so as to provide a means for connecting the boiler to the blowdown tank while precluding flow to a drain line 42, or alternatively, means for connecting the blowdown tank to the drain line 42 while precluding flow from the boiler to the blowdown tank 32. The three-way, two port valve 36 can also be moveable to a third position wherein fluid flow through the valve is prevented. Stated alternatively, the three-way, two port valve 36 is arranged such that communication can be achieved between only two of the openings or ports of the valve 36 at any one time. An example of a suitable three-way, two port valve is illustrated in the Anderson U.S. Pat. No. 3,908,605 referred to above.

In the illustrated arrangement, when the three-way, two port valve 36 is in a position to permit flow of water into the blowdown tank 32, that water will flow from the three-way, two port valve through a pipe 44 and check valve 46 into the upper end of the blowdown tank 32. When the blowdown tank contains water and the three-way, two port valve 36 is actuated to cause it to connect the blowdown tank 32 to the drain line 42, the water will flow through the drain line 48 and check valve 50 into the drain line 42, through a drain valve 43, and into a pressure reduction chamber 52. The water is then discharged from the pressure reduction chamber 52 into a sewer line (not shown).

Means are also provided for controlling the flow of water through the bottom blowdown lines 34 and 40. In the illustrated arrangement, this means can include control valves 54 and 56, respectively, each of these control valves 54 and 56 being conventional and adapted to be operated by an electric valve motor 58, electrically connected to a main controller 60 to be described more particularly hereinafter.

The three-way, two port valve 36 is similarly operated by means of an electric motor 62, connected to the main controller 60, and the drain valve 43 is also controlled by an electric motor 64. These valves and valve control motors are also conventional and will not be described in detail.

In the illustrated arrangement, the front bottom blowdown line 34 also includes a manual drain line 66 including a manually operable valve 68. The rear bottom blowdown line similarly includes a manual drain line 70 also including a manually operable drain valve 72.

Means are also provided for selectively connecting the water columns 24 and 26 of the boiler 10 to the blowdown tank 32 such that the water from the boiler can be discharged through a selected one of the water columns 24 and 26 into the blowdown tank 32 in the same manner as water is discharged from the front and/or rear bottom blowdown lines 34 and 40 into the blowdown tank. While the means for selectively connecting the water columns to the blowdown tank could have various configurations, in the illustrated construction it includes a water column blowdown line 76 connected to the three-way, two port valve 36. A manual control valve 78 and an electrically operated column blowdown control valve 80 control flow of water from the water column 24 to the water column blowdown line 76. The other water column 26 is connected to the water column blowdown line 76 through a manual control valve 82 and an electrically operated water column blowdown control valve 84. The valves 80 and 84 are driven by motors 86 electrically connected to the main controller 60.

Means are also provided for selectively connecting the head space 23 of the boiler 10 to the blowdown tank 32 so that the blowdown tank 32 can be pressurized. This means includes a steam line 90 connected to the boiler head space 23 and connected through a manual valve 92, a check valve 94, and an electrically operated steam control valve 96 to the upper end of the blowdown tank 32. In the illustrated construction, a pressure gauge 98 is connected to the steam line 90 downstream of the electrically operated control valve 96 and so as to provide means for indicating the pressure in the blowdown tank 32. A manually operated valve 100 can also be provided.

Means are further provided for selectively cooling the blowdown tank 32 and the water or steam contained in the blowdown tank. While it will be understood that various means could be provided for cooling the blowdown tank 32, in the illustrated arrangement the blowdown tank 32 is surrounded, at least in part, by a water jacket 102. A cold water supply line 104 is connected to the water jacket 102 so as to selectively provide cooling water to the water jacket. Flow of water into the water jacket is controlled by a check valve 106, and an electrically actuated control valve 108. A manual valve 110 can also be provided to permit manual control of the water flow into the water jacket 102. A manually operable flow control valve 111 is also provided in the illustrated arrangement to permit control of the rate of water flow through the cold water supply line 104.

In the construction illustrated in FIG. 1, cooling water flowing through the water jacket 102 is intended to be discharged through a discharge line 112 into a conventional boiler water makeup tank (not shown). In a preferred form of the invention the cooling water discharge line 112 includes a check valve 114 and a manually operated control valve 116. A temperature sensor 113 is connected to the cooling water discharge line and is electrically connected to the main controller. In a preferred embodiment of the invention, the apparatus also includes temperature probes 115 and 117, temperature probe 115 being electrically connected to the controller 60 through a temperature sensor 119, and,the other temperature probe being connected to a gauge 121.

Operation of the blowdown apparatus will now be described. For purposes of description, the sequence of operations is described as commencing with the blowdown tank being filled with water from the last blowdown operation. When the level of dissolved solids of the water in the boiler reaches a predetermined value, the electrically operated control valve 96 in the steam line 90 is caused to open, thereby causing steam to flow into the blowdown tank 32, and simultaneously, the three-way, two port valve 36 and the valve 43 are opened to connect the blowdown tank to the drain. The water in the blowdown tank is discharged through the drain lines 48 and 42 into the pressure reduction chamber 52 and into the sewer line. The valve 96 is then closed, and the cooling water control valve 108 is opened to provide for flow of cooling water into the water jacket 102, thereby reducing the temperature of the tank 32 and causing condensation of the steam filling the blowdown tank. Condensation of the steam results in a vacuum in the blowdown tank. Simultaneously valve 43 is closed and valve 36 is repositioned to the blowdown position. A selected one or more of the blowdown valves 54, 56, 80 or 84 is then actuated to cause one or more of the blowdown lines 34, 40 or 76 to be connected to the blowdown tank 32. Water will flow from the boiler 10 into the blowdown tank 32, driven by the steam pressure in the boiler 10 and the vacuum existing in the blowdown tank. The selected blowdown valve is then closed. The water in the blowdown tank can then be allowed to cool or it is cooled by causing water to flow through the cooling jacket 102.

While, for purposes of illustration, the operation of the blowdown cycle, when initiated, has been described as commencing with the discharge of water from the blowdown tank, it will be understood by those skilled in the art that this operation comprises a repetitious cycle of which there is no true beginning point.

Additionally, while the blowdown cycle has been described as including the step of cooling the water discharged by the boiler 10 into the blowdown tank 32 prior to discharging water from the blowdown tank, as will be described in connection with the alternative embodiment shown in FIG. 2, the water in the blowdown tank could be discharged immediately through a heat exchanger into a drain. While the blowdown tank 32 is a convenient cooling vessel, its predominant purpose is to provide a closed vessel for accepting a portion of the water from the boiler and for limiting the amount of water which can be discharged from the boiler.

Means are also provided for discharging surface water from the boiler 10. In the illustrated construction this means for discharging surface water from the boiler includes a surface blowdown line 120 operably connected through an electrically operated control valve 122 to a heat exchanger 124. The control valve 122 is adapted to be operated by an electric motor 126 electrically connected to the main controller 60. In a preferred form of the invention, the control valve 122 is conventional and can be operated to cause controlled or proportional flow. The control valve 122 is actuated by a conventional motor 126 responsive to the controller 60 so as to cause accurately controlled proportional increased or decreased flow through the valve 122.

The heat exchanger 124 includes a heat exchange coil 128, and cooling water is supplied to the heat exchanger through a cooling water inlet line 130. In the embodiment illustrated in FIG. 1, the heat exchanger cooling water is discharged from the heat exchanger through a line 132 to the boiler water makeup tank. A thermally operated valve 134 is provided for controlling the flow of cooling water to the heat exchanger 124. The surface water from the boiler 10 is discharged from the heat exchanger 124 through a drain line 138 adapted to discharge the water into a sewer line. The drain line 138 includes a temperature sensing element 141 connected to valve 134 and adapted to control flow of cooling water through the heat exchanger 124.

Means are also provided for sensing the state of the water in the boiler, i.e., the quantity or level of dissolved solids in the water in the boiler 10 and for controlling blowdown in response to the measured state of the water in the boiler 10. More particularly, this means includes means for continually or periodically measuring or testing the water in the boiler to determine the level of dissolved solids in the water. While various means could be provided, in the illustrated arrangement this means for testing the water includes a conventional conductivity probe assembly 140 operably connected to the surface blowdown line 120. In the illustrated arrangement, means are also provided for causing a controlled flow of water through the surface blowdown line 120 to permit the conductivity sensor 140 to read the conductivity of the water in the boiler 10. This means includes a bypass conduit 142, bypassing the surface blowdown control valve 122 and providing for controlled flow of water through the surface blowdown line 120 into the heat exchanger 124. An electrically-operated control valve 144 is provided in the bypass conduit 142 to provide for controlled flow of water through the surface blowdown line 120. Manual control valves 148 are also provided for permitting manual control of flow through the surface blowdown line 120. While in the illustrated construction the water flowing through the conductivity probe assembly 140 is discharged to a drain, in other arrangements it could be returned to the boiler water make-up tank.

Means are also provided for controlling bottom blowdown, column blowdown and surface blowdown in response to the conductivity of the water in the boiler as sensed by the conductivity probe assembly 140. While the means for controlling blowdown could have other constructions, in one preferred form of the invention, the main control 60 comprises a programmable controller operably connected to the electrically-operated control valve referred to above and in a manner to be described more particlarly hereinafter. While various commercially available programmable controllers could be employed, an example of a suitable programmable controller 60 is a Square D SY/MAX Model 300 programmable controller. It will be understood by those skilled in the art that, while in the illustrated form of the invention the main controller is comprised of a programmable controller, in other arrangements conventional timers and relays could also be employed, or other electronic control apparatus could be used. The use of a programmable controller is preferred over the use of conventional timers and relays or other discrete controls because it permits programming of the operation of the blowdown apparatus to accomodate the particular characteristics of the boiler. Use of the programmable controller also produces substantial cost savings in connection with wiring of the apparatus, can be reprogrammed rather than rewired in the event changes are desired, and also yields more reliable operation.

Referring more particularly to the main controller 60 as being comprised of a programmable controller as referred to above, the controller can be programmed to effect operation of the blowdown apparatus as follows. The controller operates the sample valve 144 so as to provide for either periodic or a small continuous flow of water through the conductivity sensor 140. When the conductivity sensed indicates that the quantity of dissolved solids in the boiler 10 has reached a first level, for example, 2,000 micromhos, the main controller will initiate a blowdown cycle. Once the blowdown cycle is initiated, the main controller 60 can simultaneously activate the three-way, two port valve 36, the drain valve 43, and the steam supply valve 96 to provide for discharge of the water in the blowdown tank 32 through the drain lines 48 and 42 and filling of the blowdown tank with steam. When this process has been completed so as to empty the blowdown tank, the main controller 60 will then cause each of the valves 43 and 96 to close. Simultaneously valve 36 is repositioned to the blowdown position. The main controller 60 can then cause actuation of the cooling water flow control valve 108 to provide for flow of cooling water through the water jacket 102 to provide for condensation of steam in the blowdown tank. The main controller 60 can be programmed so as to select blowdown through one of the bottom blowdown lines 34 or 40 or one of the water column lines 24 or 26. The controller 60 will cause opening of the appropriate valve 54, 56, 80 or 82 to effect flow of water from the boiler 10 so as to cause flow of water into the blowdown tank 32 until the blowdown tank 32 is filled to the required level. The selected blowdown valve is then closed by the main controller 60. If it is desired to cool the water in the blowdown tank 32, the main controller 60 will then cause the valve 108 to open, thereby providing for flow of cooling water through the water jacket 102. The water in the blowdown tank will then be retained until commencement of the next blowdown.

In a preferred form of the invention, the main controller 60 will be programmed to permit blowdown through the bottom blowdown lines 34 and 40 and water column lines 24 and 26 in sequence. For example, the main controller 60 can provide for five blowdown cycles through the bottom blowdown lines 34 and 40, first through one bottom blowdown line and then through the other bottom blowdown line, and in the sixth blowdown cycle, the controller 60 will cause blowdown through one of the columns 24 or 26.

One of the advantages of the invention is that blowdown can be first through one water column 24 or 26 and then through the other. This provides for large volumes of water flow through the selected water columns 24 or 26 and the float chambers 28 or 30 so as to effectively clean out the selected water column and float chamber. This high-volume, high-velocity water flow is amplified because of the vacuum existing in the blowdown tank 32 at the initiation of blowdown.

The main controller further includes means for initiating surface blowdown in the event the level of dissolved solids in the water in the boiler exceeds a second level, for example 2100 micromhos, as measured by the conductivity probe assembly 140. In a preferred form of the invention, the blowdown tank capacity and the means for cooling the blowdown water are selected so as to have the capability of maintaining the level of dissolved solids in the boiler water within the selected first and second levels. However, it is possible that boiler operating conditions could change or the water conditions could change and thereby call for increased blowdown. Accordingly, in a preferred form of the invention means are further provided for causing a proportional increase in surface blowdown by further opening the surface blowdown valve if the dissolved solids or conductivity climb above the second level. Stated alternatively, in this embodiment of the invention, if the level of dissolved solids begins to climb above the 2100 micromho level, the motor 126 will cause further opening of the valve 122 to increase the amount of blowdown through the valve 127 until the valve 122 is fully open at a conductivity level of, for example, 2200 micromhos. The main controller 60 continues the surface blowdown until the level of dissolved solids measured falls below the second level.

By providing this combination of surface blowdown with the means for controlling sequential bottom blowdown, it is possible to maintain the content of the dissolved solids in the boiler water between narrow limits. This in turn permits the use of minimal quantities of chemicals in the water to control precipitation of minerals in the boiler water or in the boiler pipes. Since the level of dissolved solids does not fluctuate dramatically, it is not necessary to add chemicals in amounts sufficient to handle peaks in the levels of dissolved solids in the water.

A further advantage of the invention is that variable or proportional surface blowdown permits a gradual increase in the quantity of hot water flowing into the heat exchanger thereby avoiding thermal shock of the heat exchanger and extending its life.

Another of the advantages of the apparatus described above is that the provision of the programmable controller and valve arrangement permits the further employment of means for counting and displaying the number of times various valves open. The means for counting can provide for counting each time the bottom blowdown valve opens. It can also count each time the low water cutoff device senses a low water condition. It can further indicate the elapsed time of surface blowdown and thereby indicate the amount of water flowing through the surface blowdown valve. This provides a safety check to permit the operator to visually determine if all valves and the low water cutoff device are operating correctly.

The employment of the programmable controller also provides means for monitoring the amount of water being used by the boiler, and controlling the amount of chemicals added to the boiler water, and the amount of water being discharged into the drain. This control permits improved monitoring and control over the efficiency of operation of the boiler.

Another feature of the provision of a programmable controller is that means can further be added to electrically bridge the low water cut off switches of the water columns during blowdown of the water columns. This permits continued normal operation of the boiler during water column blowdown. A control means can further be provided for triggering an alarm and/or shutting down the boiler in the event that the bridge fails to break after a predetermined time period.

Figure 2:
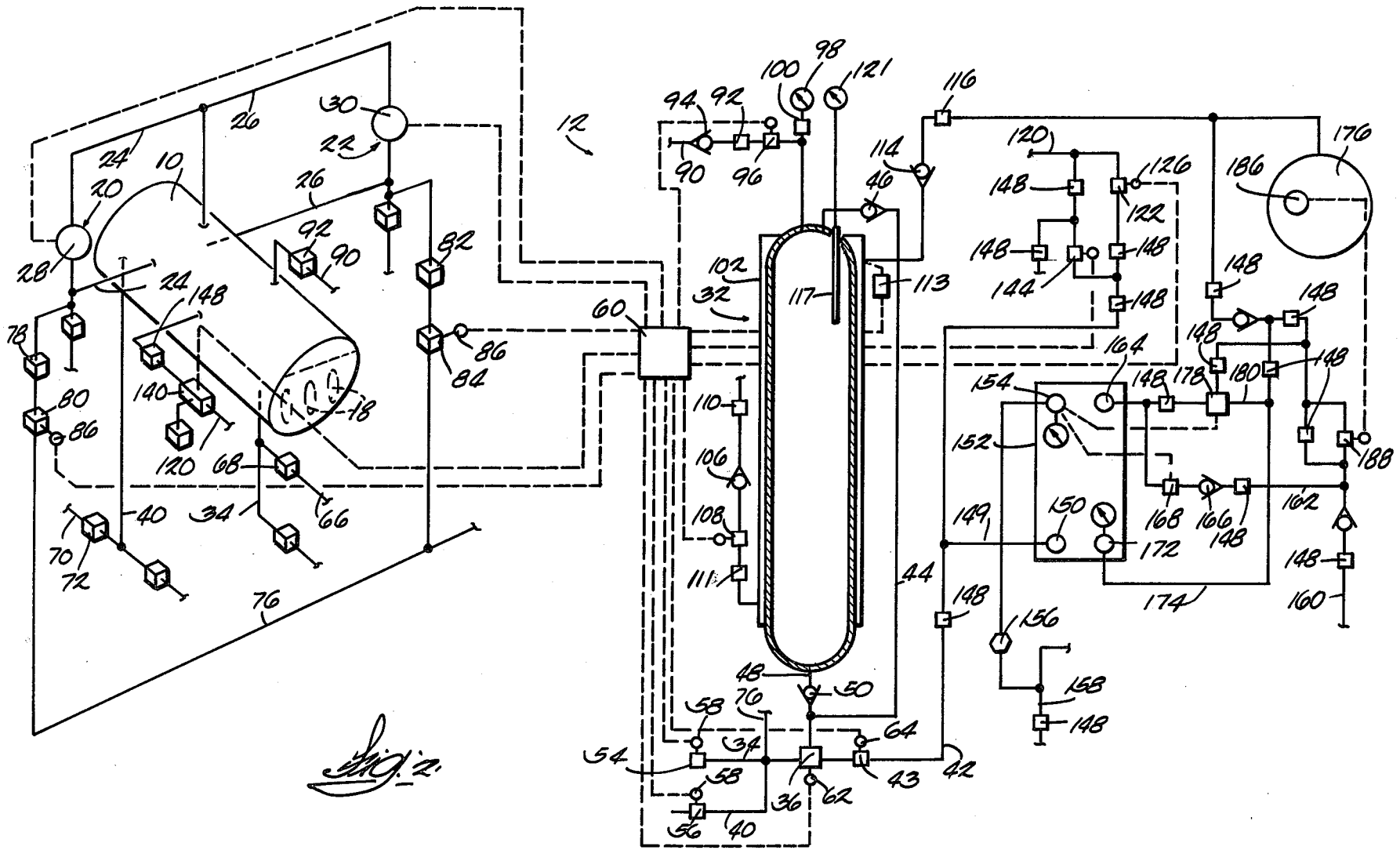
FIG. 2 is a schematic view of apparatus comprising an alternative embodiment of the invention.

FIG. 2 illustrates an alternative embodiment of the blowdown apparatus illustrated in FIG. 1, and further including means for connecting the drain line 48 of the blowdown tank 32 to a heat exchanger such that the water exhausted from the blowdown tank 32 can be cooled prior to its discharge into a drain line. The elements shown in FIG. 2 which are common with those shown in FIG. 1, are numbered the same and will not be described in detail.

The drain line 48 of the blowdown tank and the surface blowdown line 120 are connected through another line 149 to the hot water inlet 150 of a heat exchanger 152. The heat exchanger 152 also includes a hot water outlet 154 connected to drain piping 158. In the particular embodiment illustrated, this arrangement also includes a conventional back pressure regulator 156.

Means are also provided for controlling the flow of cooling water through the heat exchanger 152 such that the water discharged is at a temperature which can be discharged into a sewer system. In the illustrated construction, the means for controlling flow of cooling water includes a cold water inlet line 160 connected by a line 162 to the cold water inlet 164. The line 162 includes a manual valve 148, a check valve 166 and a temperature controlled cooling water valve 168. The cooling water valve 168 is connected to a temperature sensor at the hot water outlet 154 of the heat exchanger 152, and the cooling water valve 168 functions to cause increased cooling water flow through the heat exchanger 152 in response to an increase in temperature of the hot water discharged through the hot water outlet 154. The heat exchanger 152 also includes a cooling water outlet 172 connected by line 174 to the boiler water makeup tank 176.

In the illustrated construction, the boiler water makeup tank 176 also includes means for controlling the volume of water contained in the tank. This means includes a float control apparatus 186 electrically connected to an electrically operated makeup tank feed control valve 188. If the water level in the makeup water tank is reduced to a selected level, the valve 188 will cause flow of makeup water to the makeup tank. A diverting valve 178 is also provided to divert the flow of water from valve 188 to the cold water inlet of the heat exchanger or directly to the boiler makeup tank. The temperature controlled diverting valve 178 is connected to a temperature sensor at the hot water outlet 154. When the temperature sensed at hot water outlet is above a selected value, the diverting valve 178 diverts the cooling water to the heat exchanger. If the temperature sensed is below the selected value, the diverting valve will divert the cooling water through line 180 to the makeup tank. The diverting valve 178 is a conventional valve and its structure will not be described in detail.

While this system has been described as being applicable to use with a single boiler, it will be understood that the blowdown apparatus described above could be used to blowdown more than one boiler, and while only one blowdown tank is illustrated, the system could include one or more blowdown tanks depending on blowdown capacity required. It will also be readily understood that the capacity and number of heat exchangers employed is also dependent on the quantity of water discharged.

Various features of the invention are set forth in the following claims.

I claim:

1. Apparatus for automatically periodically discharging a predetermined quantity of water containing impurities from a boiler including a head space adapted to contain steam, a first water column and a second water column, the apparatus comprising a closed blowdown tank adapted to receive a charge of water containing impurities from the boiler, means for selectively connecting the head space of the boiler to the blowdown tank, and means for alternatively and selectively connecting the water columns to the blowdown tank and to a drain, said means for alternatively and selectively connecting including means for precluding connection of the water columns to the blowdown tank when the blowdown tank is connected to the drain, said means for alternatively and selectively connecting including means for selectively controlling discharge of water from said first water column into said blowdown tank and means for selectively controlling discharge of water from said second water column into said blowdown tank.

2. Apparatus as set forth in claim 1 wherein said means for alternatively and selectively connecting the water columns to the blowdown tank includes means for first connecting one of the water columns to said blowdown tank and then the other of the water columns to said blowdown tank.

3. Apparatus as set forth in claim 1 wherein said means for alternatively and selectively connecting the water columns to the blowdown tank further includes a programmable electronic controller and means responsive to said programmable electronic controller for first connecting one of the water columns to said blowdown tank and then the other of the water columns to said blowdown tank.

4. Apparatus for automatically periodically discharging a predetermined quantity of water containing impurities from a boiler including a head space, a first blowdown outlet in a bottom part of the boiler, a surface blowdown outlet for discharging surface water from the boiler, said surface blowdown outlet being above the first blowdown outlet, a first water column, and a second water column, the apparatus comprising:

a closed blowdown tank adapted to receive a charge of water containing impurities from the boiler, means for selectively connecting the head space of the boiler to the blowdown tank, means for selectively connecting said first blowdown outlet, said first water column, and said second water column to the blowdown tank, and means for selectively connecting said blowdown tank to a drain, said means for selectively connecting said blowdown tank to a drain including means for precluding connection of the first blowdown outlet and the water columns to the blowdown tank when the blowdown tank is connected to the drain.

5. Apparatus as set forth in claim 4 and further including means for controlling discharge of water from said first blowdown outlet, said water columns and said surface blowdown outlet in response to the level of dissolved solids in said boiler, said means for controlling including means for sensing the quantity of dissolved solids in the water in the boiler, means for causing discharge of water from said boiler through selected of said first blowdown outlet and said water columns when the quantity of dissolved solids in said water reaches a first predetermined level, and means for causing disharge of water from said surface blowdown outlet when the quantity of dissolved solids reaches a second predetermined level, said second level behind higher than said first level.

6. The apparatus as set forth in claim 5 wherein said means for causing water to be discharged from said surface blowdown outlet includes means for increasing the amount of water discharged through said surface blowdown outlet in response to an increase in the quantity of dissolved solids in the water in the boiler, when the quantity of dissolved solids in the water in the boiler rises above said second predetermined level.

7. Apparatus as set forth in claim 6 wherein said means for sensing the condition of the water senses the amount of dissolved solids in the water in the boiler and wherein said means for increasing the amount of water discharged includes means for varying the amount of water discharged in proportion to the level of dissolved solids in the water in the boiler.

8. Apparatus as set forth in claim 7 wherein said means for sensing the condition of the water in the boiler includes means for measuring the conductivity of the water in the boiler.

9. Apparatus as set forth in claim 5 and further including a heat exchanger operably connected to said second blowdown outlet of said boiler for cooling water from said boiler discharged through said second blowdown outlet.

10. Apparatus as set forth in claim 4 wherein said means for causing discharge of water to the blowdown tank includes a first valve means for controlling connection of said first blowdown outlet to said blowdown tank, a second valve means for controlling connection of said first water column to said blowdown tank, and a third valve means for controlling connection of said second water column to said blowdown tank, and a programmable electronic controller operably connected to said valves and controlling operation of said valves.

11. Apparatus as set forth in claim 10 wherein said programmable electronic controller causes sequential operation of said valves.

12. Apparatus for automatically periodically discharging a predetermined quantity of water containing impurities from a boiler including a head space adapted to contain steam, a first blowdown outlet in a bottom part of the boiler, and a second blowdown outlet for discharging water from the boiler, the second blowdown outlet being above the first blowdown outlet, the apparatus comprising:

a closed blowdown tank adapted to receive a charge of water containing impurities from the boiler, means for alternatively and selectively connecting the first blowdown outlet of the boiler to the blowdown tank and to a drain, said means for alternatively and selectively connecting including means for precluding connection of the boiler to the blowdown tank when the blowdown tank is connected to the drain, means for selectively connecting the head space of the boiler to the blowdown tank, and means for controlling discharge of water from the first blowdown outlet and the second blowdown outlet in response to the sensed condition of the water in the boiler, said means for controlling including means for sensing the quantity of impurities in the water in the boiler, means for causing discharge of water from the first blowdown outlet when the quantity of impurities in the water in the boiler reaches a first level, and means for causing discharge of water from the second blowdown outlet when the quantity of impurities in the water in the boiler reaches a second level higher than the first level, said means for causing water to be discharged from said second blowdown outlet including means for increasing the rate of discharge of water discharged through said second blowdown outlet in response to an increase in the quantity of impurities in the water in the boiler when the quantity of impurities in the water in the boiler is above said second level.

13. Apparatus as set forth in claim 12 wherein the means for sensing the quantity of impurities in the water senses the amount of dissolved solids in the water in the boiler and wherein said means for increasing the rate of discharge of water discharged includes means for varying the amount of water discharged in proportion to the level of dissolved solids in the water in the boiler.

14. Apparatus as set forth in claim 12 wherein said means for sensing the quantity of impurities in the water in the boiler includes means for measuring the conductivtiy of the water in the boiler.

15. Apparatus as set forth in claim 12 and further including a heat exchanger operably connected to the second blowdown outlet of the boiler for cooling water from the boiler discharged through the second blowdown outlet.

16. Apparatus as set forth in claim 12 wherein said means for sensing the quantity of impurities in the water in the boiler includes means for sensing the level of dissolved solids in the water in the boiler.

17. Apparatus as set forth in claim 12 wherein said means for controlling discharge of water includes a programmable electronic controller operably connected to said means for sensing the quantity of impurities in the water in the boiler, to the means for causing discharge of water from the first blowdown outlet, and to the means for causing discharge of water from the second blowdown outlet.

* * * * *